United States Patent [19]

Berbakov

[11] 4,438,600

[45] Mar. 27, 1984

[54] GRINDING, WELDING AND CUTTING APPARATUS

[75] Inventor: Paul J. Berbakov, Akron, Ohio

[73] Assignee: The Babcock & Wilcox Company, New Orleans, La.

[21] Appl. No.: 301,788

[22] Filed: Sep. 14, 1981

[51] Int. Cl.[3] ..... B24B 17/00; B24B 21/16; B23Q 35/00; B23K 7/10

[52] U.S. Cl. ..... 51/241 S; 51/241 B; 33/21 C; 266/64; 228/7; 228/29; 219/125.11

[58] Field of Search ..... 51/241 S, 241 B, 241 R, 51/135; 266/54, 55, 56, 64, 58; 33/21 C, 27 R; 228/29, 7; 219/125.11, 60 R

[56] References Cited

U.S. PATENT DOCUMENTS

| | | | |
|---|---|---|---|
| 2,878,010 | 3/1959 | Cink | 33/21 C |
| 3,172,937 | 3/1965 | Salotti | 266/56 |
| 3,215,812 | 11/1965 | Smith | 219/125.11 |
| 3,388,901 | 6/1968 | Fergurson | 33/21 C |
| 3,451,666 | 6/1969 | Evans | 33/21 C |
| 3,797,813 | 3/1974 | Rossel | 266/54 |

*Primary Examiner*—Roscoe V. Parker

*Attorney, Agent, or Firm*—Robert J. Edwards; Kenneth W. Iles

[57] ABSTRACT

A semiautomatic weld grinding apparatus for grinding the surface of a weld seam interconnecting two perpendicularly disposed tubular sections. The grinding apparatus is capable of grinding off excess weld from a saddle-type nozzle to shell weldment that follows a circular path through a plurality of planes. Alternatively, the apparatus is adaptable to function as a welding or a cutting apparatus that follows the saddle-shaped path created at the interface of two perpendicularly disposed tubular sections.

5 Claims, 6 Drawing Figures

GRINDING, WELDING AND CUTTING APPARATUS

BACKGROUND OF THE INVENTION

The present invention relates to an improved weld grinding apparatus and, more particularly, to a semiautomatic weld grinding apparatus capable of grinding off excess weld from a saddle-type weldment joining two perpendicularly oriented tubular sections wherein the weld grinding head follows a circular path through a plurality of planes as the saddle-shaped weldment is traversed. The invention also relates to an improved welding or cutting apparatus wherein the weld grinding head is replaced with either a welding head or a flame cutting head that follows the saddle-shaped path created at the interface of two perpendicularly disposed tubular sections.

The machining apparatus herein presented essentially replaces the manually operated grinding stones or wheels and the portable abrasive belt grinders heretofore used to remove excess weld from a saddle-shaped weldment joining a nozzle to a shell. The prior art method of grinding was a long, tedious, inefficient operation that was not very accurate and was more hazardous to the grinder operator, exposing the operator to abraided airborne materials and to above the ground walking about a shell that often exceeded ten feet in outside diameter, such above ground work often requiring the installation of scaffolding. Similar prior art deficiencies are applicable to welding and cutting operations, all of which are basically overcome through the use of present invention.

Relevant prior art can be found in the disclosures of Cink, U.S. Pat. No. 2,878,010 and Salotti et al, U.S. Pat. No. 3,172,937. Cink provides an operating tool effective zone and a follower-roller at the same radius relative to the co-axial rod, the path traced by the effective zone of the tool being the exact path of the line of intersection of the surfaces of the intersecting or to be joined cylinders. The present invention, however, provides for independent adjustment of both the cam follower assembly and the operating tool relative to the shaft which is co-axial with the nozzle. By adjusting the radius of the cam follower assembly such that, when rotated, its rise and fall in following the surface of the cam matches the desired rise and fall of the tool, the tool path will approximate the path of the line of intersection of the cylinders. Therefore, by providing radial adjustment of the cam follower assembly and operating tool relative to the shaft, the present invention provides an apparatus which utilizes a single cam operable through a plurality of cylinder sizes and cylinder size ratios to accomplish grinding, welding or cutting as the tool follows the saddle-shape curve formed by the junction of two perpendicularly oriented cylinders. In Cink and in Salotti et al, the cam or template used has a one to one correspondence such that the tool path trace mirrors the cam followed, thereby necessitating an inventory of cams for different curvatures, whereas the apparatus of the present invention is operable over a variety of curved surfaces utilizing a single cam or template, notwithstanding a vast potential combination of cylinder sizes.

SUMMARY OF THE INVENTION

The present invention relates to an improved weld grinding apparatus that is typically used to grind off excess weld from a saddle-shaped nozzle to shell weldment connecting the two perpendicularly disposed tubular sections. The inventive apparatus is a device which can be easily mounted on a nozzle with the aid of a self-centering mounting device. The apparatus is characterized in a single cam, an adjustable cam follower assembly, and a floating grinding head. Prior to use, the cam follower assembly is positioned horizontally while the floating grinding head is adjusted radially, the follower assembly and grinding head further being secured against horizontal displacement. During apparatus use, a driving device imparts orbital motion to the cam follower assembly and floating grinding head both of which are free to move vertically as the grinding head follows the weld seam along a circular path through a plurality of planes. Alternatively, the grinding head can be replaced with either a welding head or a cutting head to provide a welding or cutting apparatus that follows the saddle-shaped curve formed at the interface of two perpendicularly disposed tubular sections.

The various features of novelty which characterize the invention are pointed out with particularity in the claims annexed to and forming a part of this disclosure. For a better understanding of the invention, its operating advantages and specific results obtained by its use, reference should be made to the accompanying drawings and descriptive matter in which there is illustrated and described a typical embodiment of the invention.

DETAILED DESCRIPTION OF THE PREFERRED EMBODIMENT

Figure 1:
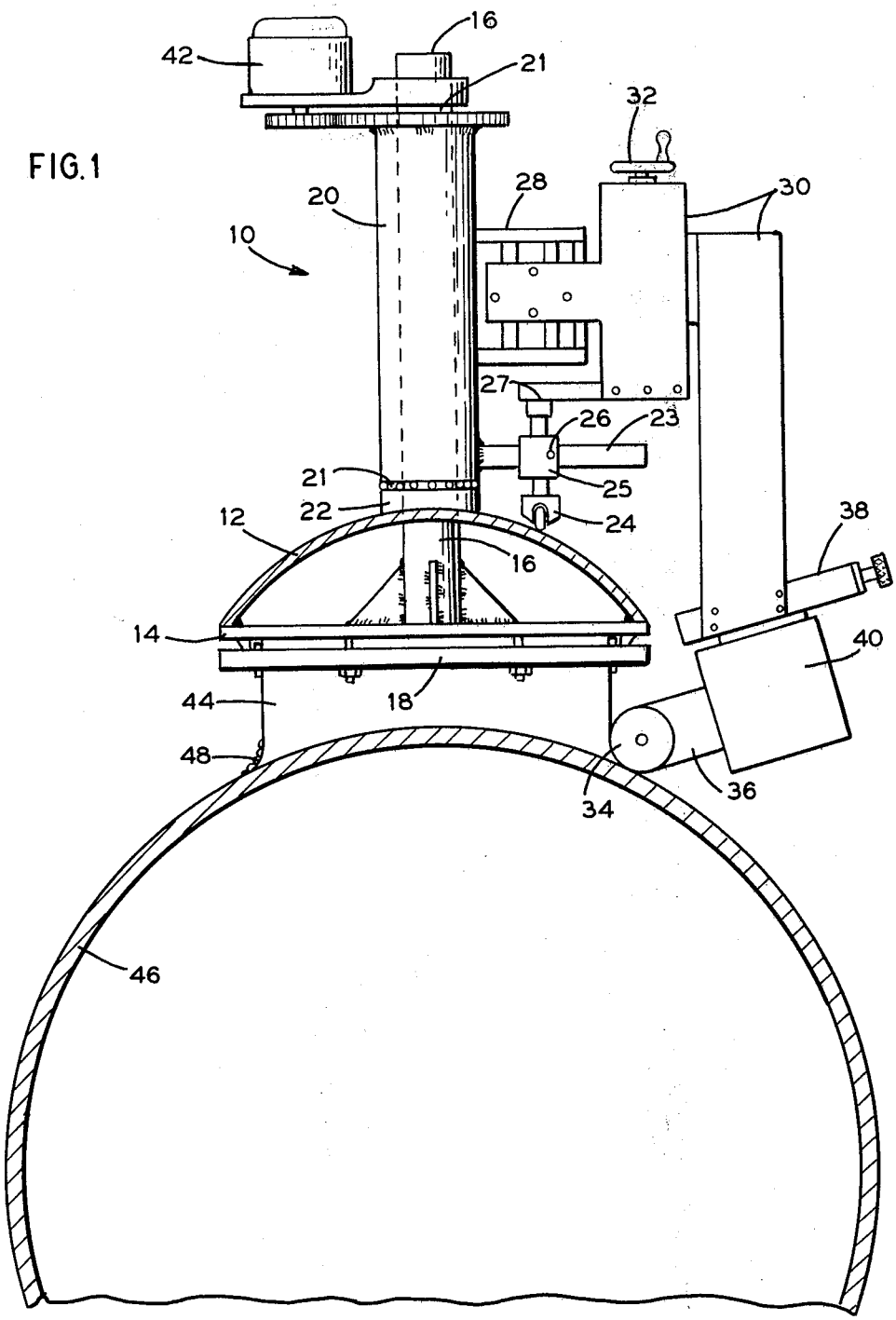
FIG. 1 is an elevation view depicting the weld grinding apparatus in the working position.

Referring to FIG. 1, there is illustrated an embodiment of the invention depicting an elevation view of weld grinding apparatus 10 in the working position. Weld grinding apparatus 10 comprises several parts and includes a cam 12 connected to mounting plate 14. Cam 12 is a curved segment of a cylinder. Neither the radius of curvature nor the cam size is critical, however, as will be discussed below, the change in altitude of the cam must be at least equal to the rise and fall of the weld to be traversed. A shaft 16 passes through an opening centrally located in cam 12, the shaft 16 further being connected to and in perpendicular orientation with mounting plate 14 and supported thereby. Alternatively, shaft 16 can be connected to and in perpendicular orientation with cam 12 and supported thereby. A sleeve 20 is disposed about shaft 16 and is rotatably engaged therewith. A collar 22 is positioned above and communicating with cam 12. Thrust bearings 21 are provided between collar 22 and sleeve 20 to facilitate sleeve rotation and to minimize part wearing. Alternatively, collar 22 could be eliminated and thereby allow sleeve 20 to communicate directly with cam 12. A horizontal member or arm 23 is connected to sleeve 20 and communicates with an adjustable cam follower assembly 24 communicating with cam 12. Cam follower assembly 24 includes a cam follower housing 25 and a locking device 26. Cam follower housing 25 is slidably engaged horizontally with horizontal member 23 and cam follower assembly 24 is slidably engaged vertically with cam follower housing 25. Locking device 26, a screw, bolt, or the like, is used to secure cam follower assembly 24 against horizontal movement after positioning. A floating assembly 28 connected to sleeve 20 slidably engages positioning assembly 30 which is free to displace vertically. Positioning assembly 30 communicates with cam follower assembly 24 at surface 27, the weight of positioning assembly 30 being sufficient to maintain contact at surface 27. Alternatively, positioning assembly 30 could be connected to cam follower assembly 24 at surface 27 as long as positioning assembly 30 was then allowed to move horizontally as well as vertically with respect to floating assembly 28. A floating grinding head 34 mounted on an arm 36 is connected to positioning assembly 30 and is driven by driving means 40. A radial positioning device 38, essentially a threaded screw member, is provided to position floating grinding head 34 substantially radially with respect to sleeve 20. A positioning crank 32 is provided to allow for vertical positioning of positioning assembly 30 and floating grinding head 34. An orbital driving means 42 is connected to sleeve 20 and further supported by shaft 16. Thrust bearings 21 can be provided to minimize wear between the driving means 42 mounting and sleeve 20. Driving means 40 and 42 are driven utilizing a power source, not shown, which may be electrical, gas, pneumatic, hydraulic, or the equivalent.

Figure 3:
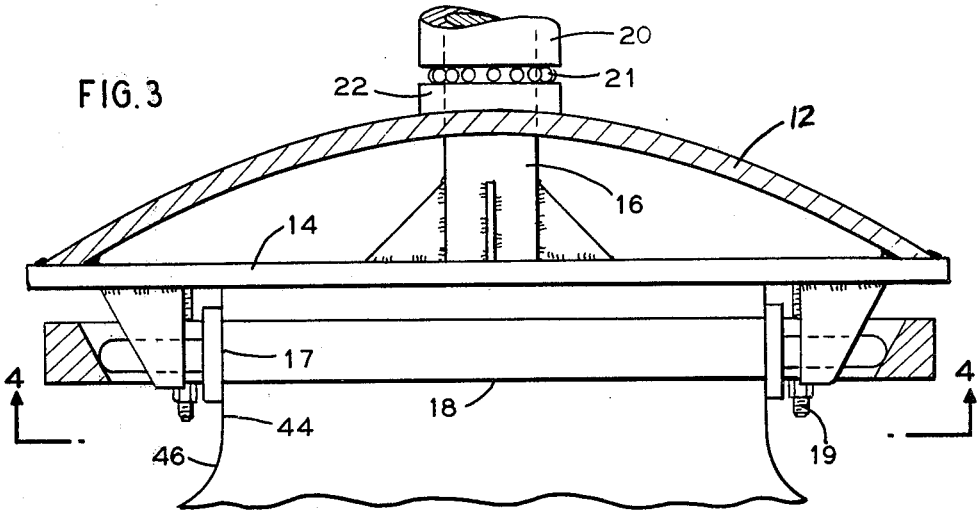
FIG. 3 is a sectional elevation view of the cam and self-centering mounting device depicted in FIG. 1.
Figure 4:
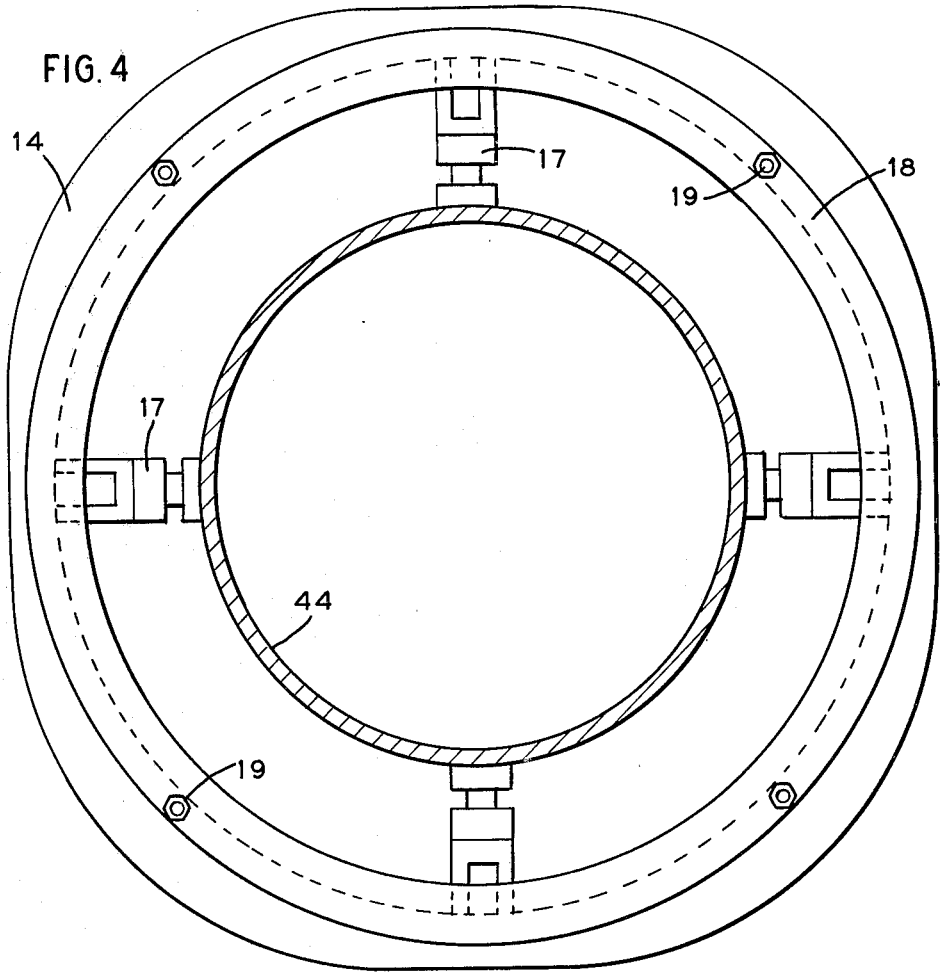
FIG. 4 is a detailed bottom view of the self-centering mounting device taken along line line 4—4 of FIG. 3.

The entire weld grinding apparatus 10 can be mounted on a nozzle 44 welded perpendicularly to a shell 46 along weld seam or weldment 48. Mounting can be achieved by utilizing a mounting device or ring 18 removably secured to mounting plate 14. Mounting ring 18 can be of the self-centering type shown in FIGS. 3 and 4, or equivalent, to provide axial alignment between shaft 16 and nozzle 44 as mounting plate 14 rests on the top of nozzle 44. The apparatus 10 is secured to nozzle 44 by ring securing assemblies 19 wherein the nuts communicating with mounting ring 18 are tightened to force mounting ring 18 upwardly and thereby driving clamping shoes 17 inwardly against nozzle 44.

Figure 2:
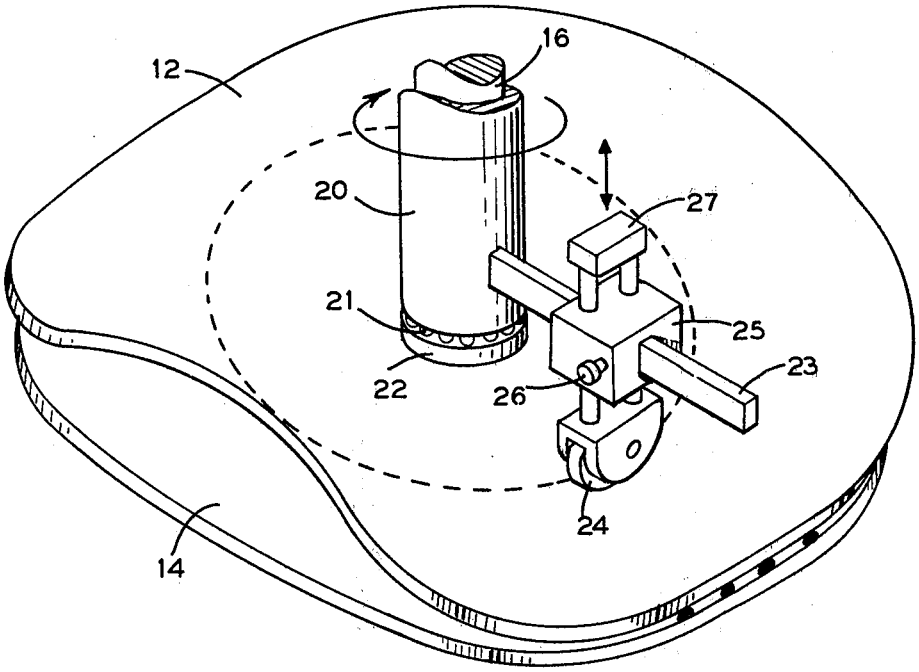
FIG. 2 is a partial isometric elevation view depicting the cam, the mounting plate, and the cam follower assembly shown in FIG. 1.

After mounting and just prior to use, floating weld grinding head 34 is positioned against weld seam 48 utilizing positioning crank 32 and cam follower assembly 24 is positioned along horizontal member 23 in the location which will allow the cam follower assembly 24 a rise and fall equal to the rise and fall of the weldment 48 to be traversed by floating weld grinding head 34. Additionally, radial positioning device 38 is used to radially position grinding head 34 and locking device 26 is used to secure cam follower assembly 24 against horizontal movement. During apparatus use, orbital driving means 42, activated by a power source not shown, imparts planetary motion to sleeve 20, cam follower assembly 24, and floating grinding head 34, cam follower assembly 24 and floating grinding head 34 being free to displace vertically, allowing the grinding head 34 to follow the weld seam 48. Weld grinding head 34 is also driven during use by driving means 40, activated by a power source not shown. Cam follower assembly 24 and weld grinding head 34 follow a circular path through a plurality of planes as the saddle-shaped weldment is traversed. FIG. 2 depicts the relative movement of sleeve 20 and cam follower assembly 24 during use.

Figure 1B:
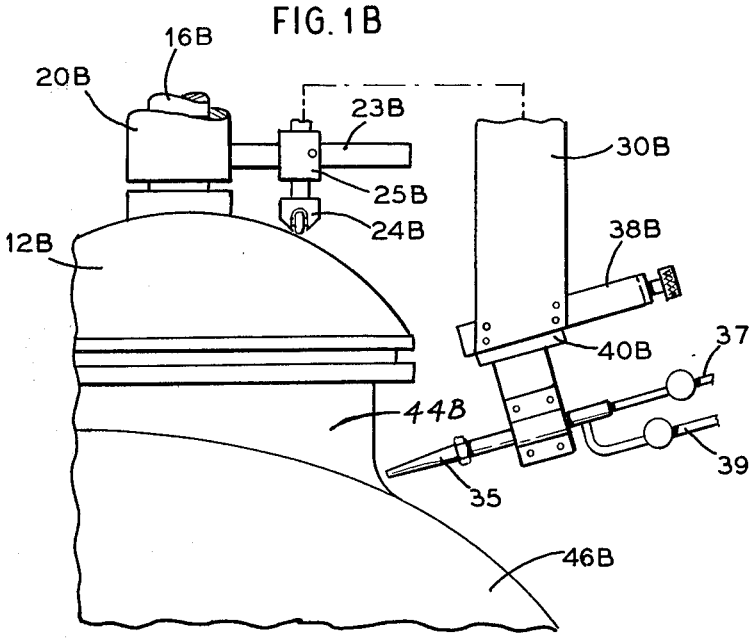
FIG. 1B is a fragmentary view depicting another alternate embodiment of the invention shown in FIG. 1.
Figure 1A:
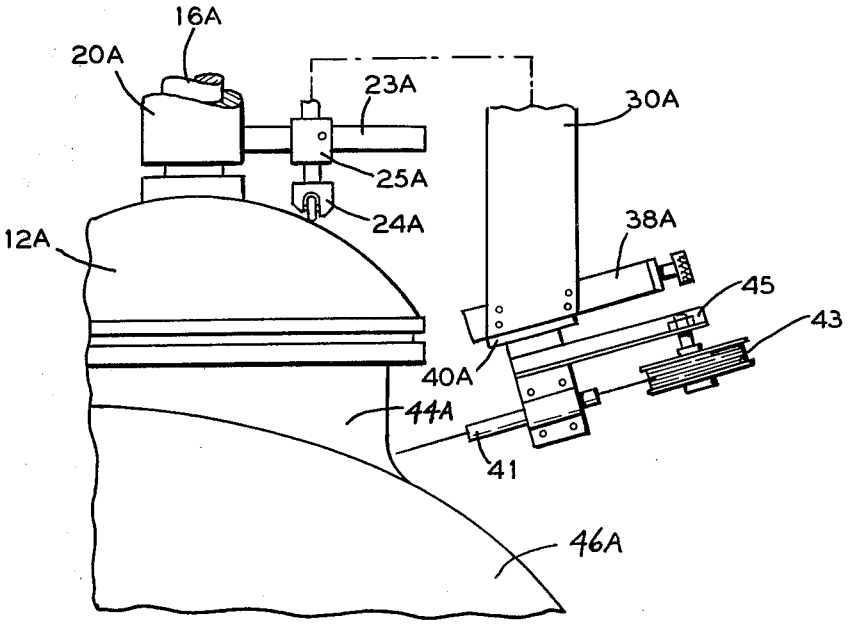
FIG. 1A is a fragmentary view depicting an alternate embodiment of the invention shown in FIG. 1.

Referring to FIGS. 1A and 1B, there are depicted fragmentary views of alternate embodiments of the invention shown in FIG. 1 wherein floating welding head 41 of FIG. 1A and floating cutting head 35 of FIG. 1B replace floating grinding head 34 of FIG. 1. Turning to FIG. 1A, there is provided a mount 45 to connect welding head 41 to positioning assembly 30A, a wire spool 43 to supply wire to welding head 41, and an energizing means 40A to provide power, source not shown, to welding head 41. Turning to FIG. 1B, a gas supply line 37 and an oxygen supply line 39 deliver gas to cutting head 35 from a supply source not shown, cutting head 35 is connected to positioning assembly 30B, and an energizing means 40B provides power, from a source not shown, to cutting head 35. All other elements depicted in FIGS. 1A and 1B are like those described with respect to FIG. 1 except that the letters A and B follow the element designation in the corresponding figure, namely, FIG. 1A and FIG. 1B. The apparatus and elements, however, operate and function as described with respect to the invention shown in FIG. 1.

While in accordance with the provisions of the statutes there is illustrated and described herein a specific embodiment of the invention, those skilled in the art will understand that changes may be made in the form of the invention may sometimes be used to advantage without corresponding use of the other features.

The embodiments of the invention in which an exclusive property or privilege is claimed are defined as follows:

1. An apparatus for controlling movement of a metal working tool along a seam interconnecting a nozzle section and a shell section comprising:

a mounting plate removably mountable on the end of a nozzle section away from the joinder of a nozzle and a shell for holding the apparatus parallel to the axis of the nozzle;

a shaft fixedly attached to said mounting plate near the center of said mounting plate and perpendicular thereto;

a cam having a generally saddle-shaped upper cam surface shaped such that said upper cam surface reproduces the seam interconnecting a nozzle section and a shell section, and such that seams formed by different nozzle and shell intersections are reproduced by said cam surface along corresponding paths of said cam surface located at different distances from the center of said cam;

a rotatable sleeve concentrically disposed about said shaft having a length substantially the same as that of said shaft, for transmitting axial rotation to the metalworking tool;

a horizontal arm fixedly attached to said sleeve;

a cam fo11ower assembly attached to and depending from said horizontal arm and contacting said cam, said cam follower being adjustable along the length of said horizontal arm;

a floating assembly fixedly attached to said sleeve above said cam follower to reproduce the up and down motion induced in said sleeve when said cam follower assembly rotates along said cam;

a positioning assembly fixedly attached to said floating assembly, said positioning assembly including a positioning crank for making vertical adjustments of said positioning assembly and a radial positioning device for making radial adjustment of said positioning device, said adjustments permitting adjustments of said positioning assembly so that the apparatus can accommodate workpieces having different diameters;

means for working along the seam attached to the lower end of said positioning assembly; including power means for operating said work means; and means for rotating said sleeve and attached elements axially about the shaft, attached to said sleeve for rotation therewith.

2. An apparatus according to claim 1 wherein said working means comprises a welding head.

3. An apparatus according to claim 1 wherein said working means comprises a cutting head.

4. An apparatus according to claim 1 wherein said working means comprises a grinding head.

5. An apparatus according to claim 1 wherein said mounting plate further comprises a plurality of circumferentially spaced driving clamping shoes for making said mounting plate self-centering.

* * * * *